US008525015B2

(12) United States Patent
Armstrong

(10) Patent No.: US 8,525,015 B2
(45) Date of Patent: Sep. 3, 2013

(54) SOUND EFFECT PEDAL

(76) Inventor: Timothy D. Armstrong, Anoka, MN (US)

( * ) Notice: Subject to any disclaimer, the term of this patent is extended or adjusted under 35 U.S.C. 154(b) by 270 days.

(21) Appl. No.: 13/068,893

(22) Filed: May 23, 2011

(65) Prior Publication Data

US 2012/0297963 A1 Nov. 29, 2012

(51) Int. Cl.
*G10H 7/00* (2006.01)

(52) U.S. Cl.
USPC ..... 84/746; 84/721; 84/670; 381/61; 381/118

(58) Field of Classification Search
USPC ..... 84/644, 670, 721, 746; 381/61–63, 381/118
See application file for complete search history.

(56) References Cited

U.S. PATENT DOCUMENTS

D261,881 S * 11/1981 Reiner et al. ..... D13/110
5,022,305 A * 6/1991 Butler ..... 84/711
5,192,904 A * 3/1993 Leiserson ..... 320/112
5,389,009 A * 2/1995 Van Schenck, III ..... 439/500
5,459,283 A * 10/1995 Birdwell, Jr. ..... 84/737
D367,258 S * 2/1996 Olexa, Jr. ..... D13/110
5,981,862 A * 11/1999 Geier, Jr. ..... 84/746
6,071,639 A * 6/2000 Bryant et al. ..... 429/97
7,326,849 B2 * 2/2008 Adams et al. ..... 84/746
7,351,905 B2 * 4/2008 Ioffe ..... 84/723
7,476,799 B2 * 1/2009 Purchon et al. ..... 84/746
7,711,442 B2 * 5/2010 Ryle et al. ..... 700/94
7,820,904 B1 * 10/2010 Robling et al. ..... 84/746
2004/0103776 A1 * 6/2004 Juszkiewicz et al. ..... 84/742
2004/0133894 A1 * 7/2004 Juszkiewicz et al. ..... 719/310
2006/0011052 A1 * 1/2006 Purchon et al. ..... 84/746
2007/0089594 A1 * 4/2007 Juszkiewicz et al. ..... 84/723
2008/0276794 A1 * 11/2008 Juszkiewicz et al. ..... 84/742
2009/0199700 A1 * 8/2009 Goldstein ..... 84/746
2012/0287691 A1 * 11/2012 Breuner ..... 363/146
2012/0297963 A1 * 11/2012 Armstrong ..... 84/746
2012/0326623 A1 * 12/2012 Fatt et al. ..... 315/291

* cited by examiner

*Primary Examiner* — David S. Warren
(74) *Attorney, Agent, or Firm* — Clayton R. Johnson

(57) ABSTRACT

A DC battery powered sound effect pedal housing with sound effect circuitry mounted therein and a battery terminal connector for being connected to battery terminals for powering the circuitry, a base and an adapter frame removably mounted intermediate the housing and the base with the adapter having said frame and an adapter power cord mounted to frame for transmitting DC power to the battery terminal connector whereby a conventional DC battery power sound effect pedal is converted to one being powered from an online AC power source without physically changing the base and housing. A convention power cord is used be powered from an AC power source to provide a DC power output that is plugged into the jack of the adapter power cord.

11 Claims, 4 Drawing Sheets

SOUND EFFECT PEDAL

BACKGROUND OF THE INVENTIONS

This invention relates to adapting a conventional sound effect pedal that is battery powered pedal to one that is powered from conventional AC power source. In particular it relates to providing an adapter for converting a conventional battery powered petal to one powered from an AC source without physically changing any part of the structure of the original pedal and can readily change back to a battery powered one.

At the present time, there are modern sound effect pedals that have a built in jack for being connected to a "on line" AC power source, and very many older battery powered sound effect pedals in use for string instruments that start draining power from the battery as soon as the cable from the string instrument is plug into the the sound receiving jack of the pedal. As a result, with battery powered devices the voltage starts dropping and after a time, for example an hour, the sound emanating during the use when playing the instrument is adversely effected. Further, after use for a few hours, the battery has to be replaced which can be relatively costly over time. The older pedals can be modified by drilling a hole into the pedal housing for connecting an on line source to power the petal internal circuitry. However, older pedal can be worth quite a bit, for example, about two to twelve hundred dollars. Drilling a hole into the housing can substantially decrease the value of the pedal.

In order to provide novel structure (adapter) for modifying a battery powered sound effect pedal to one that is powered from a conventional AC power source without making a physical change (without modifying) the battery powered pedal, for example, such as drilling hole in its housing, this invention has been made.

SUMMARY OF THE INVENTION

The sound effect pedal includes a conventional pedal housing, a convention pedal base, and an adapter intermediate the base and housing that mounts an adapter cord having a power inlet jack which is electrically connected to an adapter connector that is connectable to a battery type terminal connector that is snapped onto the terminals of a pedal battery for powering conventional pedal circuitry. The pedal circuitry is mounted in the hosing.

One of the objects of the invention is to provide new and novel means for converting a battery powered sound effect petal to one powered by an electrical AC power source. A further object of this invention is to provide a new and novel adapter that is removable mountable between the housing and base of a convention sound effect pedal for converting the convention sound effect pedal from a battery powered one to one powered from a convention AC source without making any physical changes to the conventional base and cover.

DESCRIPTION OF THE PREFERRED EMBODIMENT

Figure 1:
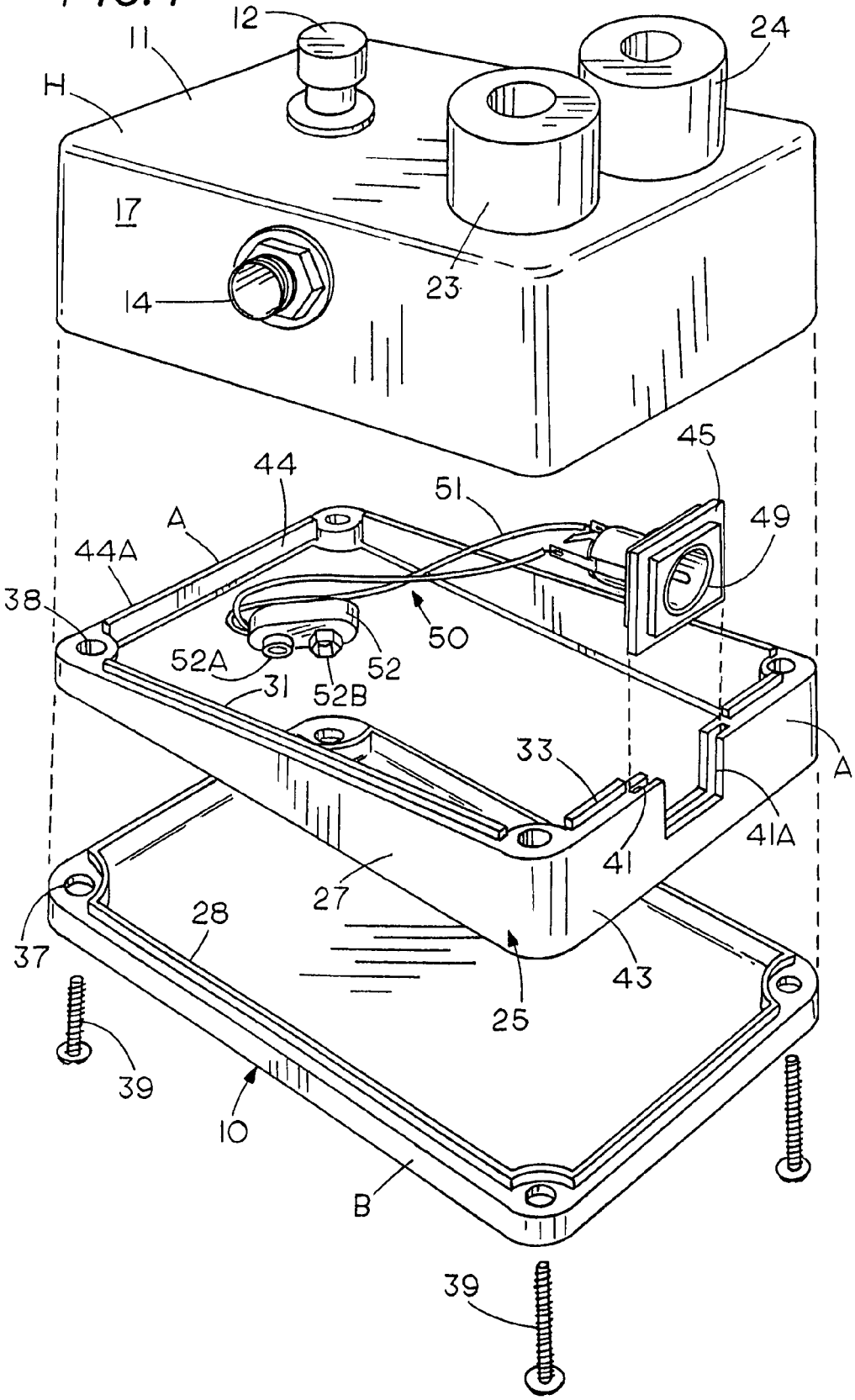
FIG. 1 is an exploded perspective view of the sound effect pedal of this invention.
Figure 2:
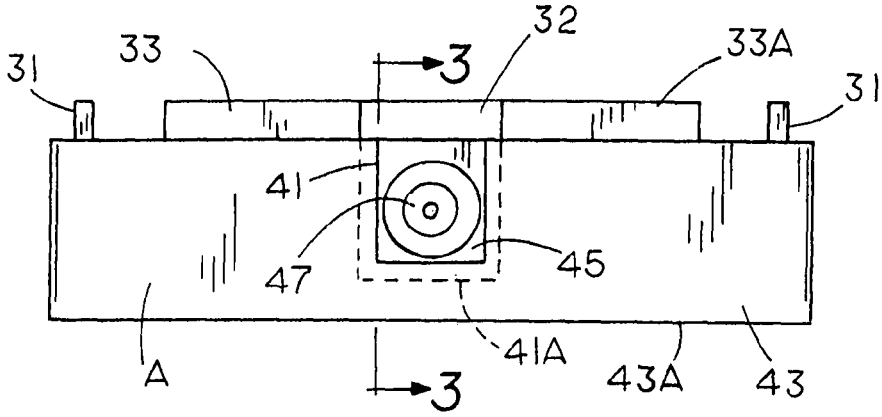
FIG. 2 is a front view of the adapter of the sound effect pedal of FIG. 1.
Figure 3:
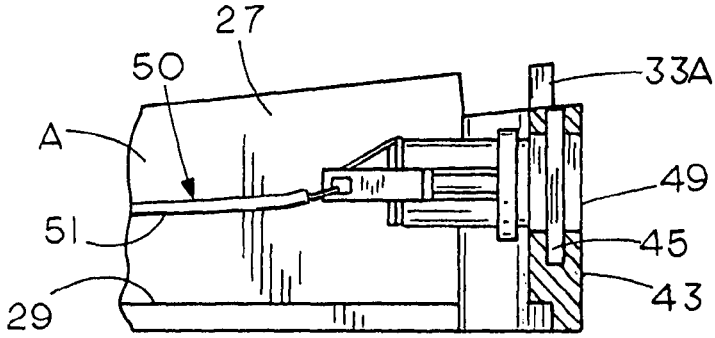
FIG. 3 is a fragmentary cross section view of the adapter that is generally taken along the line and in the direction of the arrows 3-3 of FIG. 6.
Figure 4:
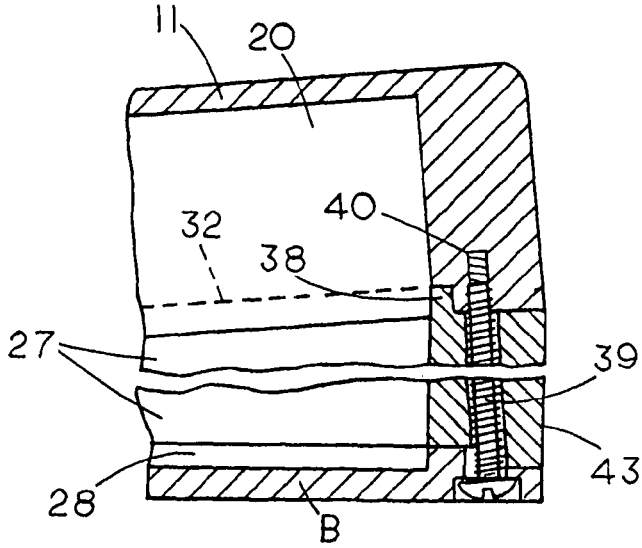
FIG. 4 is a fragmentary cross sectional view of the sound effect petal of FIG. 1 with a vertical intermediate portion broken away, said view being generally taken along the line and in the direction of the arrows 4-4 of FIG. 6.
Figure 5:
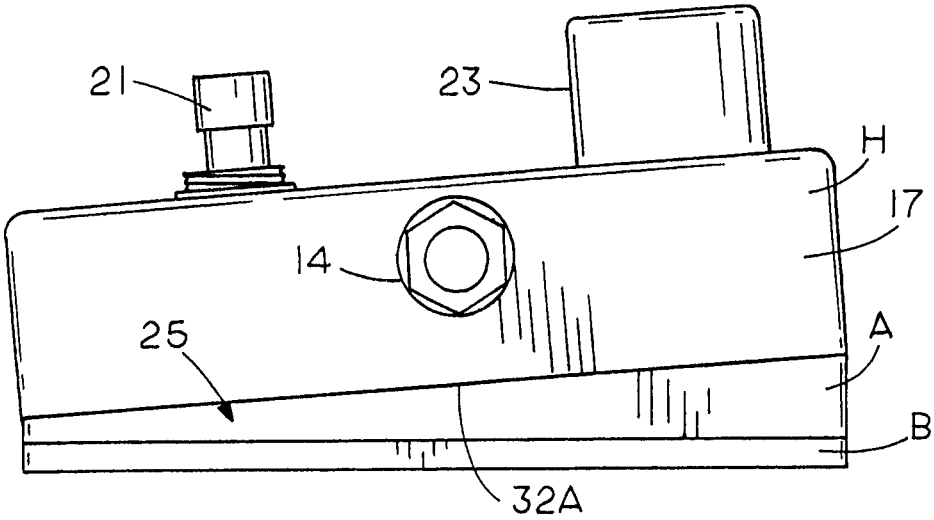
FIG. 5 is a side view of the sound effect pedal of FIG. 1.
Figure 6:
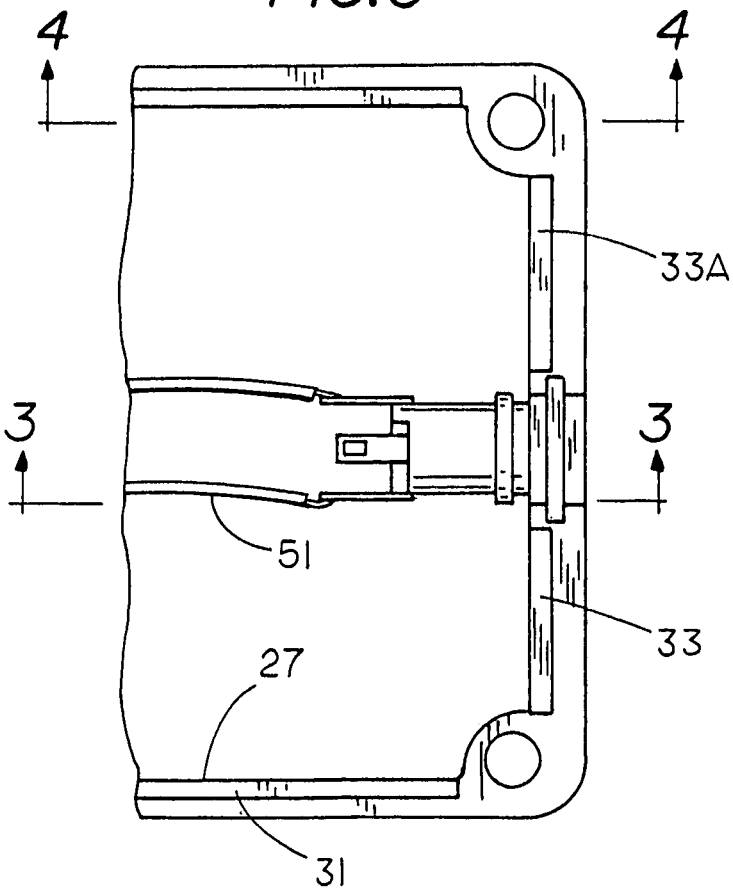
FIG. 6 is fragmentary top view of the adapter and base.
Figure 7:
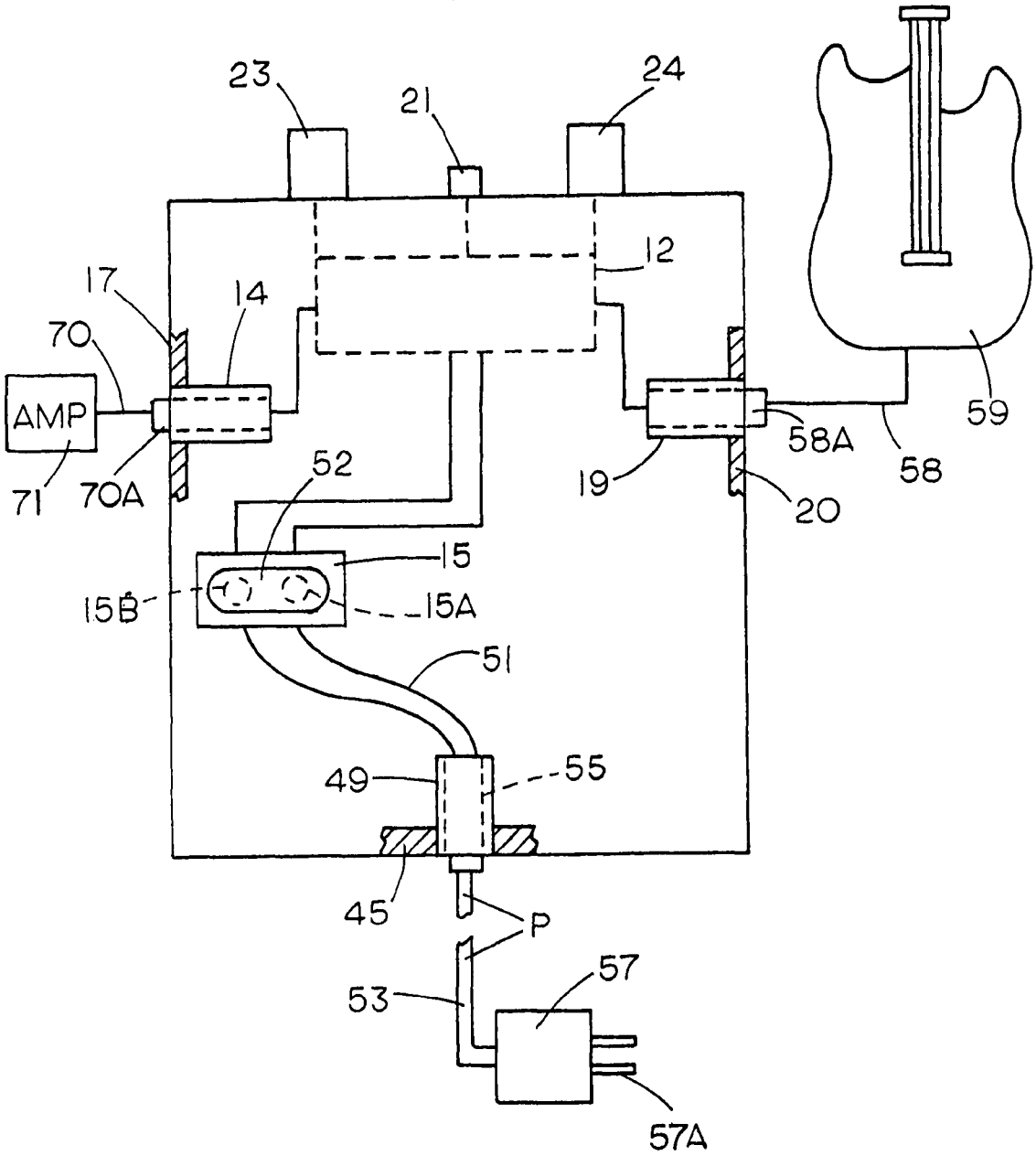
FIG. 7 is a somewhat diagrammatic showing of the components for powering the pedal circuitry and connecting the string instrument to the amplifier.

Referring to the drawings, and in particular to FIG. 1, there is shown the sound effect pedal of this invention, generally designated 10, in a disassembly condition. The pedal 10 includes a convention open bottom, generally rectangular housing H, a conventional, generally rectangular base B and screws (not shown) for removably securing the base directly to the housing when being used as a conventional battery powdered pedal. The housing mounts conventional pedal circuitry 12 that is shown by a dotted line block in FIG. 7 and is connected to a sound output jack 14 that is mounted by the side wall 17 of the housing and is connected to a sound input jack 19 that is mounted by the other side wall 20 of the housing. A push button 21 that is operably connected to the pedal circuitry is mounted on the top wall 11 of the housing that upon being push down by a foot results in changing the emitted sound effect while control knobs 23 and 24 are mounted by the top wall 11 and connected to the ciruitry for selectively changing sound effects provided by the circuitry. Further, a snap on battery terminal connector 15 is connected to the circuitry for powering the circuitry and can be snapped onto the battery terminals of, for example a 9 volt battery (not shown), the connector having snap on contacts 15A, 15B for being snap on the respective negative and positive terminals of a battery (not shown) for powering the conventional pedal.

For converting a conventional DC powered sound effect pedal such as described above, there is provided an sound effect adapter A of this invention. The adapter includes a generally rectangular adapter frame, generally designated 25, that is open at the top and bottom (see FIG. 1). The frame has a perimetric bottom notch 29 to receive the perimetric flange 28 of the base to facilitate the alignment of the adapter with the base during assembly. Further, the frame side walls 27 have upper flanges 31 extendable into notches 32 in the housing, the rear wall 44 has a rear flange 44A extendable into housing rear wall notch (not shown) and the flanges 33, 33A of the front wall 43 extendable into the housing notches 34.

Since the adapter frame front wall 43 is of a greater height than the rear wall 44 and the perimetric bottom edge 43A of the frame wall is substantially planer, the adapter side walls 27 are trapezoidal whereby the top wall is sloped to make it easier for the user using a foot for operating the button 21. In each corner portion of each of the base and adapter there is provided a bore 37 and 38 respectively extended therethrough for having screws 39 extended therethrough and threaded into bores 40 of the housing for retaining the housing, adapter and base in an assembled condition. Since the housing bottom perimetric edge 32A is planar and the base flange perimetric top edge is planar with the planes being parallel in a convention pedal assembly position, screws (not shown) are of a shorter length than screws 39. However, when the housing, adapter and base are in an assembled condition, the central axes of the housing bores are not coaxial with those of the adapter and base and accordingly the bores of the adapter are sufficiently large and the base bores have upper bore portions are of smaller diameters than lower bore portions with screw heads extend therein to permit the screws 39 extending at a slight different angles than when the short screws are used to assemble the base directly to the housing.

The adapter frame front wall 43 includes an upward opening, generally U-shaped slot 41 with a similarly shaped groove 41A to have the rectangular jack mount 45 of the adapter power cord, generally designed 50, slidably mounted therein. The jack mount top edge abuts against the housing and mounts the inlet DC power jack 49 of the cord. Leads 51 connect the power jack to posts 52*a*, 52*b* of the adapter connector 52 that form a snap fit with the contacts 15A, 15B of the connector 15.

A conventional power source power cord P has a plug 55 pluggable into the adapter jack 49, a cable 53 connecting the plug to a transformer 57 that has prongs 57A that can be plugged into a conventional wall socket (not shown) of an on line AC power source. The transformer provides a step down DC voltage suitable for operating the pedal circuitry. A cable 58 has a plug 58A that is plugged into the jack 19 to connect the musical stringed instrument 59, for example an electric guitar, for transmitting sound to the pedal circuitry while a cable 70 has a plug 70A that can be plug into jack 14 for transmitting sound from the pedal circuitry to the amplifier 71.

With the connector 52 connected to connector 15 to transmit power from cord P and the power cord plug 70 plugged into an "on line" source of AC power and the plug 58A is plugged into jack 18, the circuitry 12 is energized (starts drawing power). The sound emanating from the string instrument, for example an electric guitar or the like, and broadcasted by the amplifier is modified by depressing the push bottom 21. The modification is depended on the circuitry provided in the housing. It is to be understood that a number of pedals with modifications in the their respective circuitry can be mounted to a pedal board to provide different sound effects. Further the pedal of this invention may have a conventional foot pedal (not shown) mounted to the housing for depressing the push bottom.

It is be understood the size and shaped of the adapter depends the model of the conventional DC powered pedal that is to be modified to be an AC powered one without damaging the DC powered pedal housing and base. Further, it is to be understood the housing, base and adapter may not have cooperating notches and flanges although it is preferred they do to facilitate assembly. In the event the conventional DC battery powered pedal is of a type that has its top wall sloped downwardly relative its bottom edges, than the adapter of this invention to be used therewith could have its front wall of a height that is the same as the height of its rear wall for converting the battery powered pedal to one that uses a cord P instead of a battery for powering the pedal circuitry.

What is claimed is:

1. An adaptor for modifying a string instrument effect pedal for modifying the sound output from a string instrument, comprising a pedal base, a pedal housing mountable to the base, the housing having sound effect circuitry mounted therein and a battery terminal connector connected to the circuitry for transmitting power thereto, and an adapter that includes an adapter frame mountable to be inserted between the base and housing and an adapter power cord mounted to the adapter frame for transmitting DC power to the battery terminal connector, the power cord having a power inlet jack.

2. The adaptor of claim 1 wherein each of the housing, the base and adapter frame has corner portions with more than one of the corner portions having a bore extended through, each bore of the base being aligned with a corresponding bore in each of the adapter frame and housing and a screw extending through each set of aligned bores of the housing, base and adapter frame for removably retaining the housing, base and adapter frame in an assembled condition.

3. The adaptor of claim 2 wherein the housing has a top wall and bottom edges that are in substantially in a common plane that is parallel to the top wall, the adapter frame has opposite walls that are trapezoidal and have top edges that are substantially in a common plane which is parallel to the top wall and abuttable against the housing bottom edges and bottom edges that abut against the base that are in a substantially common plane that is at angle to the plane of the top wall, the screws are extended through the bores of the base and the adapter frame and threaded into the bores of the housing, the adapter frame bores being of a sufficiently larger diameter than the maximum diameter of the housing bores to permit the screws extending at a slightly different angles than when the base is directly mounted to the base without the frame extended between.

4. The adaptor of claim 1 the adapter frame has a front wall, the cord has a DC power jack mountable by the adapter frame, an adapter connector connectable to the battery terminal connector for transmitting power thereto and a cable electrically the power jack to the adapter connector.

5. The adaptor of claim 4 wherein the frame has a front wall, the front wall has an upward opening slot and there is a jack mount mountable in the slot for mounting the jack to the adapter frame.

6. The adaptor of claim 4 wherein the each of the base, the housing and adapter frame is generally rectangular, the adapter frame has a rear wall that is of small height than the front wall and side walls that are of a generally trapezoidal shape that extend between and joined to the front and rear walls.

7. The adaptor of claim 4 wherein the housing has side walls, an inlet jack mounted to one of the housing side walls, connected to the circuitry and adapted for being connected to an electrical guitar to receive an input from the guitar and an output jack mounted to one of the housing side walls, connected to the circuitry and adapted for being connected to an amplifier for transmitting the output of the circuitry to an amplifier.

8. An apparatus for converting a DC battery powered sound effect pedal to an AC powered pedal without physically modifying the DC power pedal which has a base and a bottom opening, a housing removably mounted to the base and having a bottom edge, sound effect circuitry mounted in the housing, a battery terminal connector connectable to a battery for powering the circuitry, a string instrument input jack mounted to the housing and connected to the circuitry, an amplifier output jack mounted to the housing and connected to the circuitry and a switch operatively connected to the circuitry for selectively varying the sound at the output jack, an adapter removably mounted between the base and the housing and having a perimetric frame opening for mounting to each of the base and the open end of the housing, and an adapter power cord mounted to the adapter frame for transmitting DC power to the battery terminal connector, the power cord having a power inlet jack.

9. The apparatus of claim 8 wherein the adapter power cord is mounted to the adapter frame by having an inlet jack mount mounting inlet jack, the adpater frame having a jack mount slot for removably mounting the jack mount to have the inlet jack opening exterior of the adapter housing and the power cord has a connector for transmitting power to the battery terminal connector and leads extending within the adapter frame for connecting the inlet jack to the cord connector.

10. The apparatus of claim 9 wherein there are screws for securing the housing, base and adapter frame to one another in an assembled relationship with the adapter frame between the housing and base, each of the housing, base and adapter housing is generally rectangular and have corner portions with bores extended therethrough that are aligned with one another for having screws extended therethrough and are alignable for having the base secured directly to the housing by shorter length screws than those for securing the housing, base and adapter frame to one another.

11. The apparatus of claim 10 wherein one of the adapter frame and housing has alignment notches and the other has alignment flanges, one of the base and adapter frame has an alignment notch and the other has an alignment flange, the flanges and notches being provided to facilitate assembling the housing, base and adapter frame to one another.

* * * * *